United States Patent [19]

Schaller

[11] Patent Number: 4,747,377

[45] Date of Patent: May 31, 1988

[54] DIESEL ENGINE PRIMER APPARATUS AND SYSTEM

[76] Inventor: Onita Schaller, R.R. 2, Box 214, Hannibal, Mo. 63401

[21] Appl. No.: 924,753

[22] Filed: Oct. 30, 1986

[51] Int. Cl.[4] ..... F02M 63/00

[52] U.S. Cl. ..... 123/179 L; 123/445

[58] Field of Search ..... 123/179 L, 179 G, 445

[56] References Cited

U.S. PATENT DOCUMENTS

| | | | |
|---|---|---|---|
| 2,601,562 | 6/1952 | Schoeppner et al. | 123/187.5 |
| 2,704,536 | 3/1955 | Edwards | 123/187.5 |
| 2,788,781 | 4/1957 | Frisch | 123/187.5 |
| 2,821,183 | 1/1958 | Roosa | 123/450 |
| 2,945,483 | 7/1960 | Howell | 123/179 |
| 3,144,861 | 8/1964 | Ragon | 123/187.5 |
| 3,750,639 | 8/1973 | DiGirolamo | 123/187.5 |
| 4,161,160 | 7/1979 | Hicks et al. | 123/179 L |

FOREIGN PATENT DOCUMENTS

| | | | |
|---|---|---|---|
| 1776062 | 6/1979 | Fed. Rep. of Germany | 123/179 G |

*Primary Examiner*—Andrew M. Dolinar
*Attorney, Agent, or Firm*—A. Robert Theibault

[57] ABSTRACT

The present disclosure is directed to a portable pressurized tank and fuel system which may be connected to the secondary fuel filter of a diesel engine which has been depleted of fuel occasioned by drain down due to a prolonged period of idleness or overhaul. The tank is filled with fuel, pressurized to the engine manufacturers standards and then the fuel from the tank is fed to the engine to recharge the fuel system so that the engine may be started. The air charged and fuel filled tank may with its hoses and valves be taken to another location to start another engine.

4 Claims, 2 Drawing Sheets

DIESEL ENGINE PRIMER APPARATUS AND SYSTEM

BACKGROUND OF THE INVENTION

The present invention is directed to a portable diesel engine primer to assist starting an engine which has been overhauled, stored for a long period or out of diesel fuel. This apparatus is not a cold weather starting aid for diesel engines. The apparatus is a portable unit having an air pressurizable tank for a supply of diesel fuel which may be charged with fuel and pressurized to a predetermined air pressure depending upon the type of diesel engine to be started. The pressurized fuel is introduced to the engine through an engine cut-off valve connectable to the engine secondary fuel filter. The source of air to the tank may be from a service air charging connection such as found at most garages and filling stations. The tank is protected by an adjustable pop-off off valve which may be set to protect both the engine and the tank. The apparatus is portable and may be moved by service technicians manually about a service facility or put in a pickup truck and taken out in the field to the engine to be started.

BACKGROUND ART

Numerous auxiliary starting systems have been devised for starting diesel engines particularly in cold weather and which employ a highly combustible material which is introduced into the air box between the blower and the cylinders such as shown in U.S. Pat. No. 2,601,562. The use of volatile starting liquids is also shown in U.S. Pat. Nos. 2,788,781, 3,144,861, 2,704,536, 2,945,483, 3,750,639. The only patent known to me prior to filing this application which appreciates the problem of diesel engine start up after a lengthy shut down when part of the fuel injection system may be empty of fuel or may contain air locks so that considerable cranking is required just to fill up the fuel injection system before any effective injection to the engine cylinders takes place is U.S. Pat. No. 2,821,183 and this patent does not teach my structure and requires one auxiliary start up system per engine to which it is attached. My invention provides one system which because of its portability may be taken around an overhaul shop or out to the field to start up many engines, summer or winter.

SUMMARY OF THE INVENTION

The present invention is directed to diesel engine start up system which may service many engines without being attached permanently to just one. When diesel engines are out of use for prolonged periods such as overhaul or repair or they sit out on a job for periods of non-operation all or part of the fuel injection system may be empty of fuel and it becomes important to assure the delivery of fuel to the engine cylinders in an adequate amount and at adequate pressure independently of engine cranking speed.

Another object of the invention is to provide an engine start assist unit, portable, of light weight which can be operated from an air supply regulated by a regulator which pressurizes a tank containing diesel fuel to a pressure recommended for specific manufacturers engines. The tank may also be charged from a filling station air pump if a suitable adapter is applied to the regulator.

A further object of the invention is to provide an auxiliary start up unit for diesel engines which can be attached to the secondary fuel filter and removed after the engine has been started and taken to another engine for start up.

DESCRIPTION OF THE PREFERRED EMBODIMENT

Figure 1:
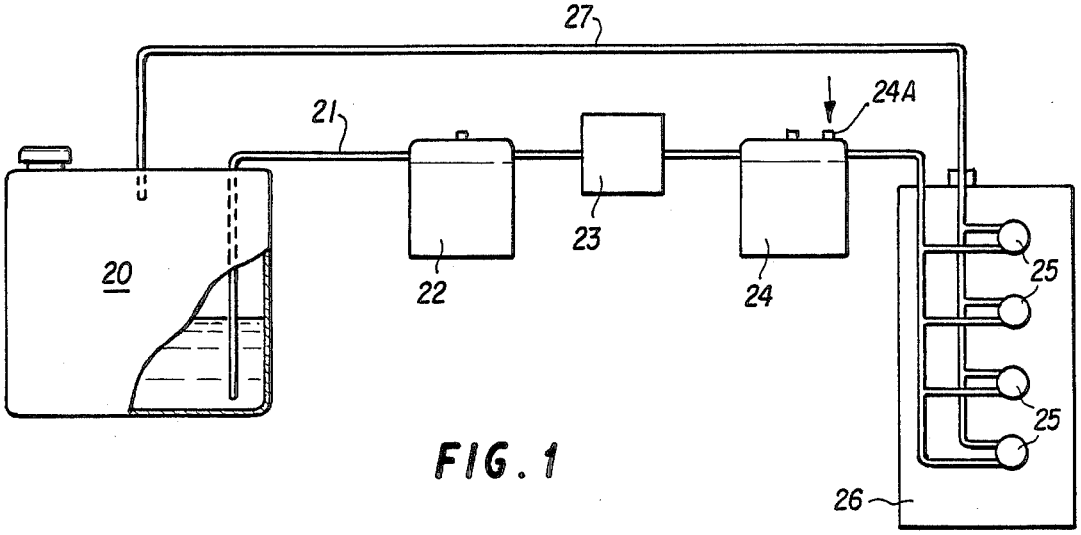
FIG. 1 is a schematic of the diesel engine fuel system with which the diesel engine primer apparatus of the present invention is employed.

Referring now to FIG. 1, a standard fuel system is shown for a standard diesel engine of the Detroit, Caterpillar, Mack, Roosa Master, Robert Bosch or Simms type having a fuel supply tank 20 which supplies diesel fuel through a primary fuel line 21 to a primary fuel filter 22, to a fuel pump 23, then to a secondary fuel filter 24, then to fuel injectors 25 in the engine 26 and through a return line 27 back to the fuel supply tank 20.

The secondary fuel filter 24 has a removable plug 24A for connecting the primer line feeder hook up 28 to re-establish the fuel level and pressure in the fuel system necessary to start the engine after a prolonged period of idleness during which time all or part of the fuel injection system may be empty of fuel requiring prolonged cranking to fill up the fuel injection system before any effective injection to the engine cylinders takes place.

Figure 2:
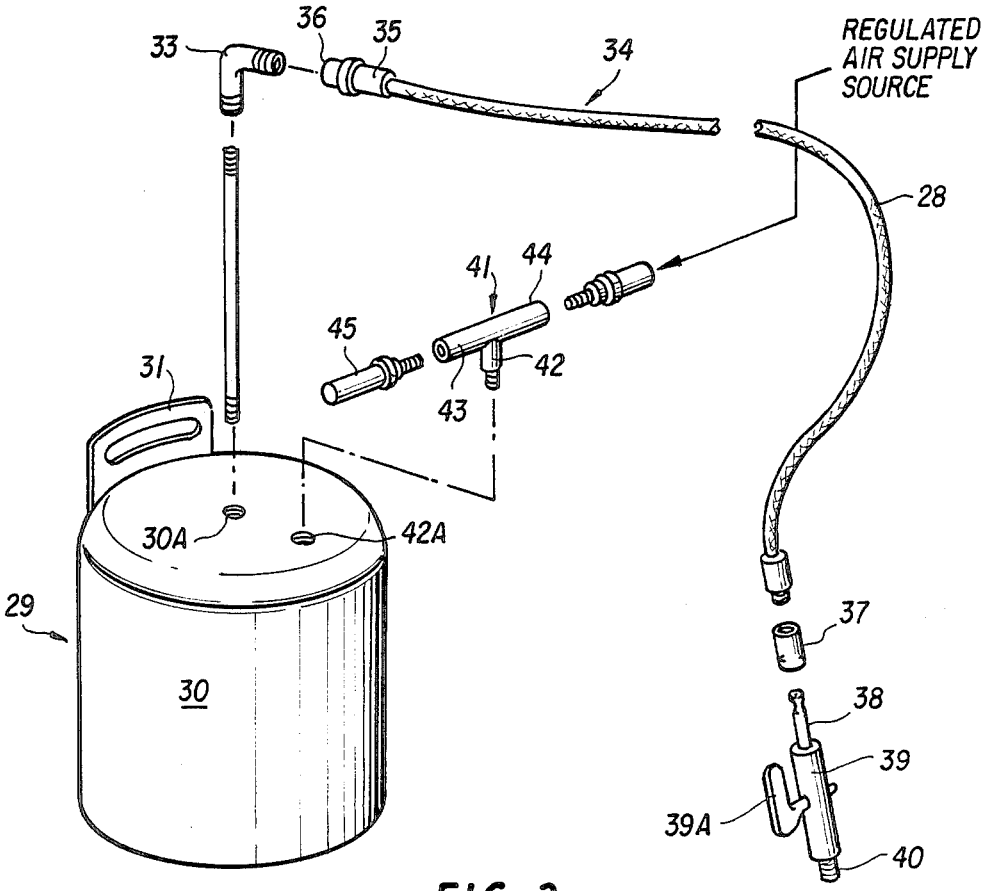
FIG. 2 is an exploded perspective view of one form of diesel engine primer apparatus constructed in accordance with the present invention.
Figure 3:
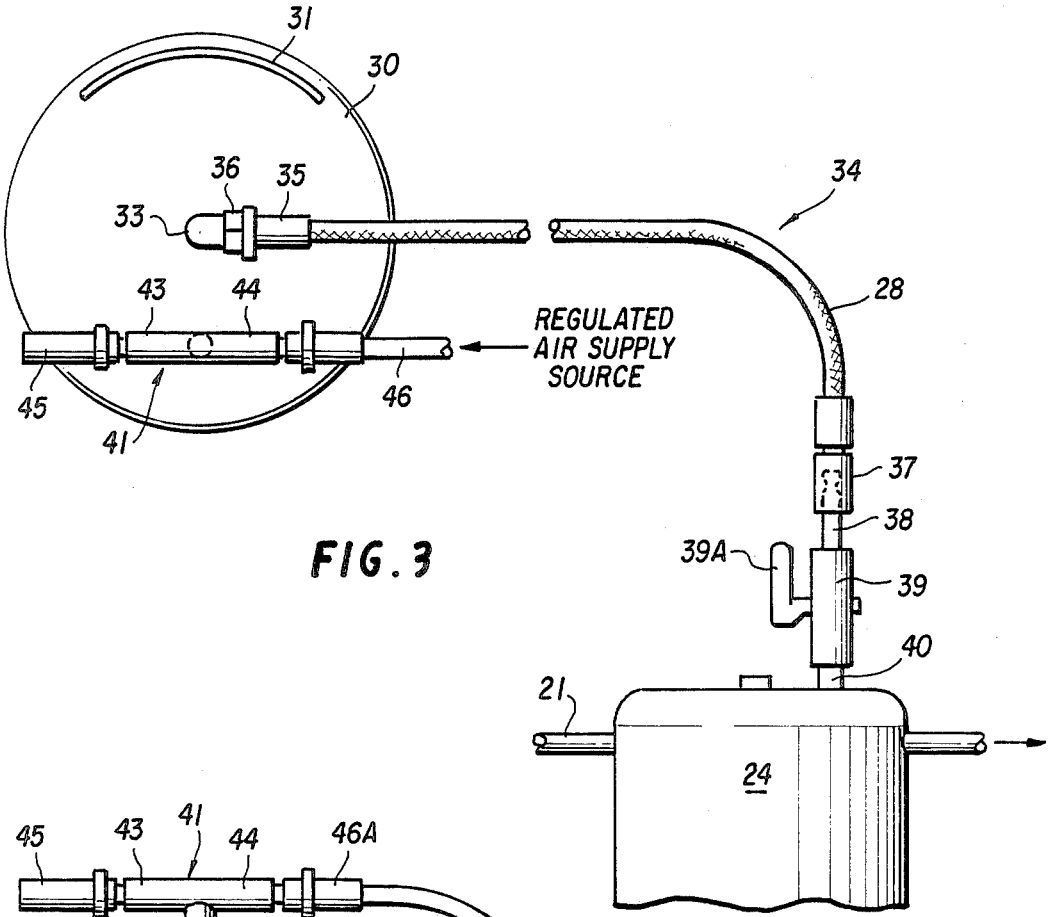
FIG. 3 is a top plan view of the air/fuel tank of my invention showing the fuel connection to secondary fuel filter of engine fuel system.

Referring now to FIGS. 2 and 3, the porrable mobile start up unit 29 is shown having a fuel/air tank 30 having a handle 31 by which it may be carried from starting site to starting site. The tank 30 has a fuel pick up tube 32 which extends from an opening 30A in the top of the tank 30 to proximate its bottom. The pick up tube 32 at its top is screw connected to a pick up tube adapter 33 which is also screw connected to a stratoflex hose 34 at 35 which has a screw fitting 36 for connection to the adapter 33 thence to a quick change coupling 37 which engages over a quick change male coupling 38 on an engine hook up valve 39 having an operating lever 39A to open and close valve 39. A screw threaded male fitting 40 connects the valve 39 to the secondary filter 24 when a threaded plug 24A is removed from the filter and the valve 39 is screwed into the filter.

Figure 4:
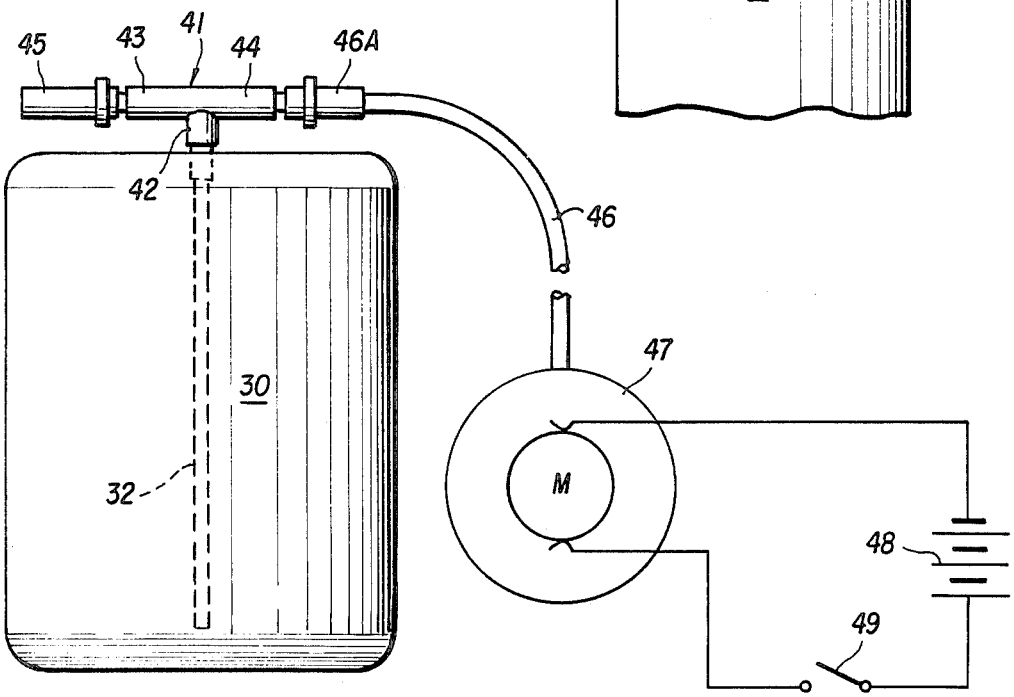
FIG. 4 is a schematic view of the air system for supplying air to the air/fuel tank of the primer apparatus constructed in accordance with the present invention.

A hollow T-shaped air connector 41 having a hollow leg 42 and two hollow arms 43, 44 is secured to the top of tank 30 for communication with its interior to pressurize the tank internally from the top. The arm 43 has an adjustable regulator valve 45 to regulate the internal tank pressure while arm 44 has an air hose connector 46A connected to a hose 46 which as best shown in FIG. 4 is supplied with pressurized air from either a motor driven compressor 47 powered by a battery 48, switch operated at 49 or by being charged with air from a filling station pump or a supply tank.

The tank 30 may be filled with diesel fuel through hose 34 by introducing fuel through the engine hook up valve 39 prior to connecting it to the secondary fuel filter 24. The tank 30 is then pressurized as best seen in FIG. 3 through air hose 46 from a reservoir tank 47A charged by the compressor 47. The tank 47A will supply a smooth even air flow to tank 30 and tank connection 46A to put a head on the fuel in tank 30 not to exceed the engine manufacturers recommended fuel pressure. This usually ranges from 45 to 60 pounds.

IN OPERATION

With fuel in the tank 30, the plug 24A, FIG. 1, is removed from the secondary fuel filter 24 and the valve 39, FIG. 2, is screwed into the plug socket, with the valve 39 closed. The regulator valve 45 is set to the desired pressure and the air hose line 46 is charged until the desired pressure is reached and the valve 45 pops off. The valve 39 is then opened to prime the engine. After the engine starts and is running smoothly the valve 39 is closed. The air feeder line 46 is disconnected from the arm 44 letting the engine refill the tank 30 for its next use. When fuel comes out hose 46 or arm 44, valve 39 is closed and disconnected from filter 24.

The engine fuel system has been recharged to normal use and the engine may be shut down and restarted when needed.

What is claimed is:

1. For use in priming a diesel engine having a primary and secondary fuel filter connected in a fuel line to injectors of the diesel engine, a diesel engine primer comprising a portable fuel/air pressurizable tank, air charging means connected to said tank to receive and regulate a predetermined head of air on a supply of diesel fuel in said pressurizable tank, a diesel fuel pick up tube extending into said tank to proximate its bottom at one end and extending externally of said tank at its top end, a hose assembly having a threaded nut engageable with a pick up tube adapter at one end, and a quick release female connector at the other end of said hose assembly for receiving the quick release male connector of an engine hook up valve connectable to the secondary filter of the engine.

2. A diesel engine primer as claimed in claim 1 wherein said air charging means to receive and regulate a predetermined head of air on a supply of diesel fuel is a hollow T-connector connected internally to the tank at the base of its hollow leg, and adjustable pop-off valve extending off one arm of said hollow T, and air charging means connected to the other arm of said hollow T for charging a head of air on the diesel fuel in said tank.

3. A diesel engine primer as claimed in claim 2 wherein said air source is a regulated pressure supply tank charged by a compressor driven by a 12 volt DC motor which may be battery driven.

4. A diesel engine primer as claimed in claim 2 wherein said air charging means is a push around 12 V DC motor driven compressor which may be driven from a cigar lighter outlet on a truck.

* * * * *